US010995395B2

(12) United States Patent
Bhadeshia et al.

(10) Patent No.: US 10,995,395 B2
(45) Date of Patent: May 4, 2021

(54) MARAGING STEEL

(71) Applicant: ROLLS-ROYCE plc, London (GB)

(72) Inventors: Harshad K Bhadeshia, Derby (GB); Paul O Hill, Derby (GB); Martin J Rawson, Derby (GB); Dominik J Dziedzic, Derby (GB); Zixin Huang, Derby (GB)

(73) Assignee: ROLLS-ROYCE plc, London (GB)

( * ) Notice: Subject to any disclaimer, the term of this patent is extended or adjusted under 35 U.S.C. 154(b) by 181 days.

(21) Appl. No.: 16/297,056

(22) Filed: Mar. 8, 2019

(65) Prior Publication Data

US 2019/0309400 A1 Oct. 10, 2019

(30) Foreign Application Priority Data

Apr. 6, 2018 (GB) ..... 1805776

(51) Int. Cl.
*C22C 38/52* (2006.01)
*C22C 33/04* (2006.01)
(Continued)

(52) U.S. Cl.
CPC ..... *C22C 38/52* (2013.01); *C21D 6/004* (2013.01); *C21D 6/007* (2013.01); *C21D 6/02* (2013.01);
(Continued)

(58) Field of Classification Search
CPC ..... C22C 38/52
(Continued)

(56) References Cited

U.S. PATENT DOCUMENTS 5,512,237 A 4/1996 Stigenberg
2004/0154707 A1* 8/2004 Buck ..... C22C 38/04 148/609
(Continued)

FOREIGN PATENT DOCUMENTS

CN 103820729 A 5/2014
CN 105568151 A 5/2016
(Continued)

OTHER PUBLICATIONS

Nedjad et al. "A new concept in further alloying of Fe—Ni—Mn maraging steels." Spripta Materialia, 2009, vol. 60, pp. 528-531.
(Continued)

*Primary Examiner* — Stefanie J Cohen
*Assistant Examiner* — Danielle Carda
(74) *Attorney, Agent, or Firm* — Oliff PLC

(57) ABSTRACT

Maraging steel alloys are disclosed. The alloys are produced by microalloying of the maraging steel alloy to form carbides at prior austenite grain boundaries to increase Zener drag. A particular example alloy consists essentially of, by weight, 7.4 to 8.4 percent nickel, 7.6 to 8.6 percent chromium, 8.4 to 9.4 percent cobalt, 1.8 to 2.2 percent molybdenum, 2 to 2.6 percent tungsten, 1.6 to 2 percent aluminium, 0.05 to 0.08 percent carbon, a carbide former selected from the group consisting of: niobium at a concentration of 0.25 to 0.28 percent; titanium, at a concentration of 0.2 to 0.28 percent; and vanadium, at a concentration of 0.21 to 0.4 percent; the balance being iron and incidental impurities.

16 Claims, 2 Drawing Sheets

(51) Int. Cl.

| | |
|---|---|
| ***C22C 38/06*** | (2006.01) |
| ***C22C 38/44*** | (2006.01) |
| ***C22C 38/46*** | (2006.01) |
| ***C22C 38/48*** | (2006.01) |
| ***C21D 6/02*** | (2006.01) |
| ***C21D 6/00*** | (2006.01) |
| ***C22C 38/50*** | (2006.01) |

(52) U.S. Cl.
CPC ..... *C22C 33/04* (2013.01); *C22C 38/06* (2013.01); *C22C 38/44* (2013.01); *C22C 38/46* (2013.01); *C22C 38/48* (2013.01); *C22C 38/50* (2013.01)

(58) Field of Classification Search
USPC ..... 420/103
See application file for complete search history.

(56) References Cited

U.S. PATENT DOCUMENTS

| | | | |
|---|---|---|---|
| 2016/0289805 | A1 | 10/2016 | Puech |
| 2016/0340752 | A1 | 11/2016 | Sugiyama et al. |

FOREIGN PATENT DOCUMENTS

| | | | |
|---|---|---|---|
| EP | 2 439 288 | A1 | 4/2012 |
| GB | 1546370 | A | 5/1979 |
| JP | S55-21584 | A | 2/1980 |
| JP | S63-134648 | A | 6/1988 |
| JP | H06-207246 | A | 7/1994 |
| RU | 2271402 | C1 | 3/2006 |
| SU | 1 640 198 | A1 | 4/1991 |
| WO | 2018/022261 | A1 | 2/2018 |

OTHER PUBLICATIONS

October 15, 2018 Search Report issued in British Application No. 1805776.0.
Aug. 12, 2019 Search Report issued in European Patent Application No. 19161478.3.

* cited by examiner

MARAGING STEEL

TECHNICAL FIELD

This disclosure relates to maraging steel alloys and their production.

BACKGROUND

Maraging steels are ultrahigh-strength steels whose microstructure is, unlike other steels, not hardened by carbide precipitates. Instead, hardening is achieved by the precipitation of intermetallic compounds. Thus attempts are normally made to reduce the amount of carbon to zero or trace quantities, since toughness and strength in the absence of carbon is optimal.

Production of maraging steels involves, broadly, an initial martensite transformation followed by an ageing process which hardens and strengthens the steel. Austenite reversion has been observed during this aging process, caused by local nickel enrichment which results in a depressed local martensite start temperature. The presence of reverted austenite in the maraged condition is generally undesirable as it reduces the overall strength of the alloy, particularly at higher service temperatures.

Further processing, such as forging to produce a final component, may also be carried out. However, during forging it is possible for the prior austenite grain size to grow significantly, particularly in length. Grains of around 100 micrometres in width and around 1 millimetre in length have been observed. Such large grain sizes may lead to anisotropic properties and an associated reduction in strength and toughness. Whilst grain refining processes exist, they are impractical for use on most machine components, such as crankshafts for piston engines, and interconnecting shafts for gas turbine engines.

SUMMARY

The invention is directed towards maraging steel alloys and methods of producing maraging steel alloys.

A maraging steel alloy is provided which may consist essentially of, by weight:

7.4 to 8.4 percent nickel;
7.6 to 8.6 percent chromium;
8.4 to 9.4 percent cobalt;
1.8 to 2.2 percent molybdenum;
2 to 2.6 percent tungsten;
1.6 to 2 percent aluminium;
0.05 to 0.08 percent carbon;
a carbide former selected from the group consisting of:
niobium at a concentration of 0.25 to 0.28 percent;
titanium, at a concentration of 0.2 to 0.28 percent;
vanadium, at a concentration of 0.21 to 0.4 percent;
balance iron and incidental impurities.

The maraging steel alloys may be provided in cast or forged form. They may be used in a component part of a gas turbine engine, or may indeed form any other article.

A method of producing a maraging steel alloy is also provided, comprising:

obtaining a set of constituent elements for a maraging steel alloy;

adding microalloying constituents including carbon and a carbide former;

forming the maraging steel alloy, including the formation of carbides at prior austenite grain boundaries to increase Zener drag.

DESCRIPTION OF THE DRAWINGS

Examples will now be described by way of example only with reference to the accompanying drawings, in which.

DETAILED DESCRIPTION

Figure 1:
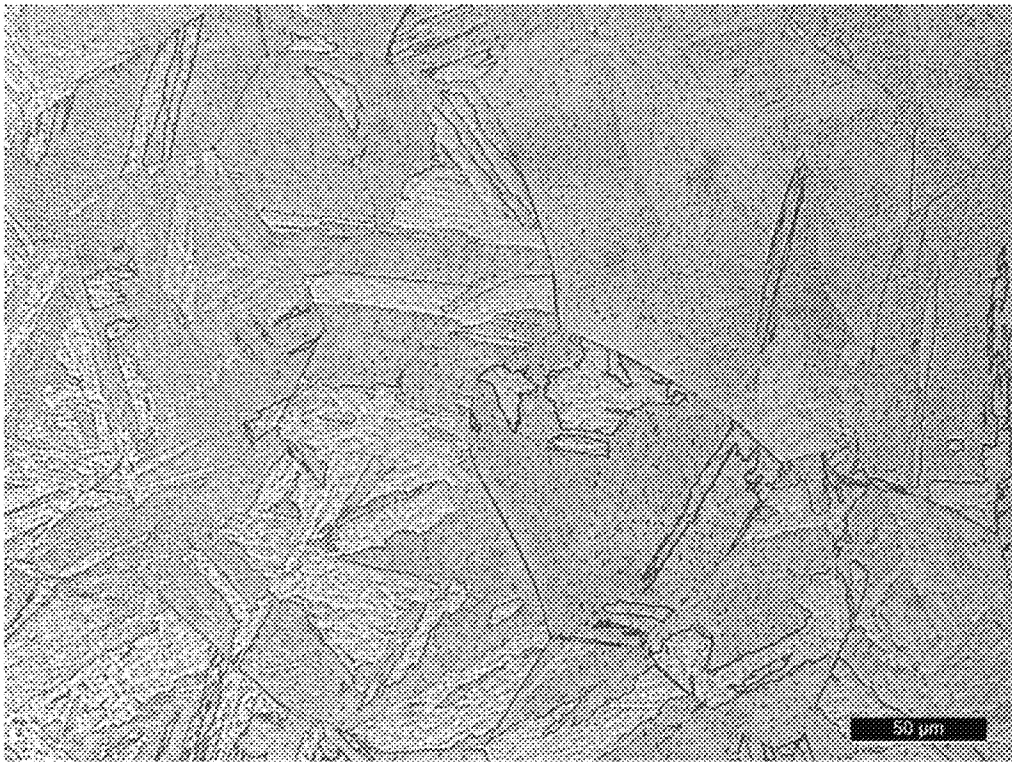
Fig. 1 (PRIOR ART)
FIG. 1 is a micrograph of the sample of Example A.

Conventional maraging steel alloys comprise negligible amounts of carbon. Whilst this absence of carbon means the martensite is quite soft, the intermetallic precipitates formed during the ageing process provide the alloys' high levels of hardness and strength.

As discussed above, it has been observed that maraging steel alloys can, during processing, suffer from austenite reversion and excessive austenite grain elongation, both of which have an associated reduction in strength.

In order to combat this, the inventors have developed a new maraging steel alloy that does not suffer from these detrimental phenomena by applying the technique of microalloying to this special class of carbon-free steel alloys. Microalloyed steels are steel alloys with microadditions of niobium, titanium, vanadium and zirconium, either singly or in combination, forming carbides thereof.

It will be immediately apparent that in the context of a conventional maraging steel, the formation of carbides is inherently problematic due to their zero, or at most trace, carbon content.

The inventors, however, have shown that it is possible to improve a maraging steel alloy by utilising a microalloying process, i.e. the addition of microalloying constituents including carbon and a carbide former to a set of constituent elements for a maraging steel alloy. When forming the maraging steel alloy, carbides form at prior austenite grain boundaries. This substantially prevents the issues of grain growth and austenite reversion. This is due to the increase in Zener drag caused by the carbides.

The volume fractions of the resulting carbides may be chosen such that they precipitate in the gamma temperature range, but are completely dissolved above the gamma temperature range. In an embodiment, the volume fraction is chosen to be of the order of $10^{-3}$.

In an embodiment, the microalloying procedure comprises addition of a stoichiometric combination of carbon and a carbide former. Thus, the amount of carbon former may be stoichiometric with respect to the carbon concentration. In this way, towards equilibrium, all of the carbon added in the microalloying process becomes associated with the carbide former, rather than remaining in the iron matrix. The carbide former may comprise one of niobium, titanium, or vanadium, to respectively form niobium carbide, titanium carbide, or vanadium carbide.

It is envisaged that other carbide formers may also be used, such as zirconium to form zirconium carbide. Alternatively, a combination of carbide formers may be used.

Specific, non-limiting embodiments of three alloy formulations will now be described.

Alloy 1

Alloy 1 comprises carbon and niobium as the microalloying constituents, and may be produced in accordance with Table 1 below, in which values are given in percent by weight:

TABLE 1

| Element | Acceptable Range | Preferred Range | Aim |
|---|---|---|---|
| C | 0.05-0.08 | 0.065-0.075 | 0.07 |
| Ni | 7.4-8.4 | 7.85-7.95 | 7.9 |
| Cr | 7.6-8.6 | 8.05-8.15 | 8.1 |
| Co | 8.4-9.4 | 8.85-8.98 | 8.9 |
| Mo | 1.8-2.2 | 1.95-2.05 | 2 |
| W | 2-2.6 | 2.25-2.35 | 2.3 |
| Al | 1.6-2 | 1.75-1.85 | 1.8 |
| Nb | 0.25-0.28 | 0.25-0.28 | 0.25 |
| Fe and incidental impurities | Balance | Balance | Balance |

Alloy 2

Alloy 2 comprises carbon and titanium as the microalloying constituents, and may be produced in accordance with Table 2 below, in which values are given in percent by weight:

TABLE 2

| Element | Acceptable Range | Preferred Range | Aim |
|---|---|---|---|
| C | 0.05-0.08 | 0.065-0.075 | 0.07 |
| Ni | 7.4-8.4 | 7.85-7.95 | 7.9 |
| Cr | 7.6-8.6 | 8.05-8.15 | 8.1 |
| Co | 8.4-9.4 | 8.85-8.98 | 8.9 |
| Mo | 1.8-2.2 | 1.95-2.05 | 2 |
| W | 2-2.6 | 2.25-2.35 | 2.3 |
| Al | 1.6-2 | 1.75-1.85 | 1.8 |
| Ti | 0.2-0.28 | 0.26-0.28 | 0.26 |
| Fe and incidental impurities | Balance | Balance | Balance |

Alloy 3

Alloy 3 comprises carbon and vanadium as the microalloying constituents, and may be produced in accordance with Table 3 below, in which values are given in percent by weight:

TABLE 3

| Element | Acceptable Range | Preferred Range | Aim |
|---|---|---|---|
| C | 0.05-0.08 | 0.065-0.075 | 0.07 |
| Ni | 7.4-8.4 | 7.85-7.95 | 7.9 |
| Cr | 7.6-8.6 | 8.05-8.15 | 8.1 |
| Co | 8.4-9.4 | 8.85-8.98 | 8.9 |
| Mo | 1.8-2.2 | 1.95-2.05 | 2 |
| W | 2-2.6 | 2.25-2.35 | 2.3 |
| Al | 1.6-2 | 1.75-1.85 | 1.8 |
| V | 0.21-0.4 | 0.28-0.4 | 0.28 |
| Fe and incidental impurities | Balance | Balance | Balance |

It should be appreciated that the different alloying elements may be provided at concentrations that form part of either the acceptable range, the preferred range, or the aim value. Thus, it will be understood that, purely by way of example, nickel may be provided at a concentration from the preferred range, chromium at its aim value, and aluminium at a concentration from the acceptable range.

In each one of Alloys 1, 2 and 3, absence of carbon dissolved in the iron matrix allows a tough, chromium- and nickel-rich martensitic structure to form on slow cooling from austenitisation temperature without the requirement for forced cooling or quenching. This microstructure has been shown to have high fracture and impact toughness properties. The addition of aluminium and cobalt increases the martensite start and finish temperatures such that the transformation is completed above standard room temperature and pressure, eliminating the requirement for a cryogenic treatment.

Creep resistance and high temperature strength is achieved through the combination of chromium, nickel and cobalt within the alloy which prevent austenite reversion during exposure to elevated temperatures.

Corrosion resistance is achieved with the chromium, nickel and molybdenum alloy additions which form a passive oxide layer and increase the pitting resistance.

Each one of Alloys 1, 2, and 3 may tolerate, in addition to other incidental impurities, the following specific impurities: manganese (up to 0.01 percent by weight); silicon (up to 0.04 percent by weight); sulphur (up to 0.003 percent by weight); phosphorus (up to 0.006 percent by weight); and nitrogen (up to 60 parts per million).

The maraging steel alloys disclosed herein may be cast or forged to form an article. They may be used, for example, in component parts of gas turbine engines, such as shafts.

The following examples compare an alloy of the prior art to an alloy according to the invention.

Example A

For purposes of comparison, a maraging steel alloy designated F1E (and which is disclosed in U.S. Pat. No. 9,217,186, which is currently assigned to the present applicant), was prepared by vacuum induction melting followed by double vacuum arc-remelting (VIM/VAR/VAR). After melting, the VAR ingot was homogenised at 1200 degrees Celsius for 48 hours. The ingot was then subjected to a two-stage forging process, comprising a first forge at 1230 degrees Celsius from 610 millimetres down to 330 millimetres, and a second forge at 1010 degrees Celsius from 330 millimetres down to 230 millimetres to produce the sample.

The sample was sealed in an individual silica tube with argon to prevent oxidation, and treated at 1100 degrees Celsius for 2 hours to dissolve all precipitates and encourage grain growth. After cooling, the sample was ground using 240-grit silicon carbide paper up to 4000-grid silicon carbide paper and polished with the use of 6 micrometre and 1 micrometre diamond paste. A final polish was performed with 0.25 micrometre colloidal silica. The sample was then etched in a solution of 20 millilitres of 60 percent concentration nitric acid, 20 millilitres of 36 percent concentration hydrochloric acid and 60 millilitres of water to reveal the grain boundaries. A micrograph of the sample is shown in FIG. 1.

Example B

A maraging steel according to the aim values of Alloy 1 as described herein was manufactured as an 80 gram melt by arc melting. Subsequent to this, vacuum homogenisation was performed at 1200 degrees Celsius for 23 hours, followed by argon cooling. The resulting sample was then swaged to 4 millimetre diameter bar.

Figure 2:
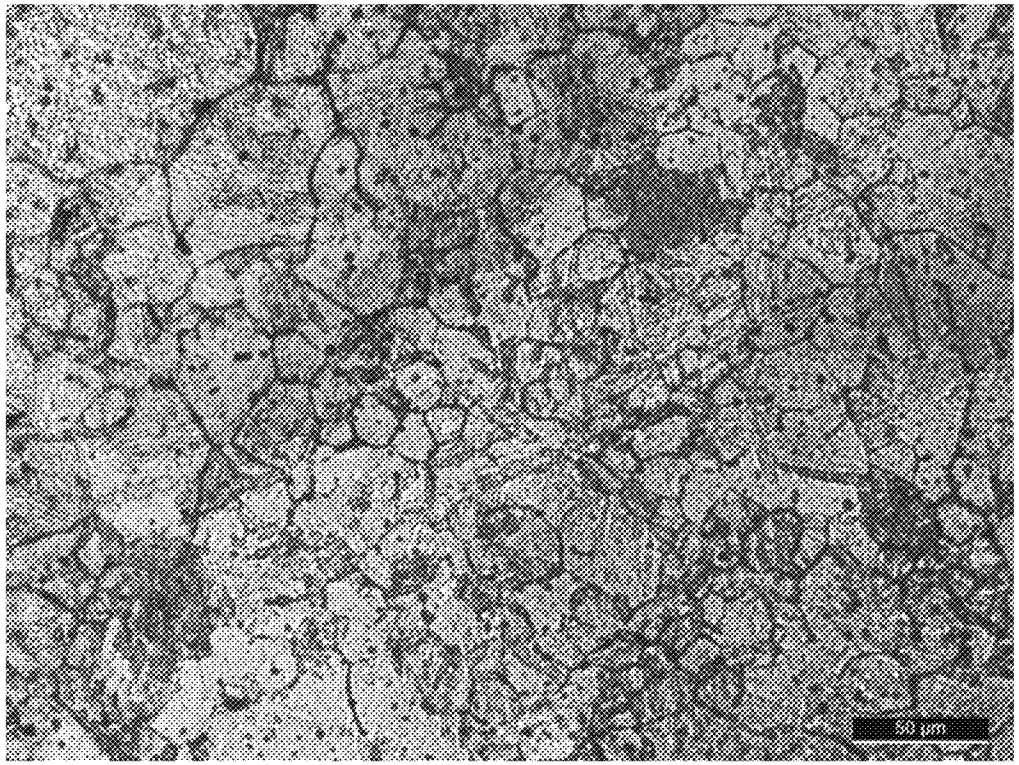
FIG. 2 is a micrograph of the sample of Example B.

The same preparation process for the sample was used as in Example A to encourage grain growth and reveal the grain boundaries. A micrograph of the sample is shown in FIG. 2. It may be seen that the austenite grains are substantially smaller in the alloy of Example B. This more refined grain structure, which is common to all of the alloys disclosed herein, improves both strength and toughness of the maraging steel alloys of the present invention as compared to prior alloys.

It will be understood that except where mutually exclusive, any of the features of the invention may be employed separately or in combination with any other features and the disclosure extends to and includes all combinations and sub-combinations of one or more features described herein.

The invention claimed is:

1. A maraging steel alloy consisting of, by weight:

7.4 to 8.4 percent nickel;

7.6 to 8.6 percent chromium;

8.4 to 9.4 percent cobalt;

1.8 to 2.2 percent molybdenum;

2 to 2.6 percent tungsten;

1.6 to 2 percent aluminium;

0.05 to 0.08 percent carbon;

a carbide former selected from the group consisting of: niobium, at a concentration of 0.25 to 0.28 percent; and vanadium, at a concentration of 0.21 to 0.4 percent;

balance iron and incidental impurities.

2. The maraging steel alloy of claim 1, in which the concentration of the carbide former is stoichiometric with respect to the carbon concentration.

3. The maraging steel alloy of claim 1, in which nickel is provided at a concentration of:

7.85 to 7.95 percent by weight; or 7.9 percent by weight.

4. The maraging steel alloy of claim 1, in which chromium is provided at a concentration of:

8.05 to 8.15 percent by weight; or 8.1 percent by weight.

5. The maraging steel alloy of claim 1, in which cobalt is provided at a concentration of:

8.85 to 8.98 percent by weight; or 8.9 percent by weight.

6. The maraging steel alloy of claim 1 in which molybdenum is provided at a concentration of:

1.95 to 2.05 percent by weight; or 2 percent by weight.

7. The maraging steel alloy of claim 1, in which tungsten is provided at a concentration of:

2.25 to 2.35 percent by weight; or 2.3 percent by weight.

8. The maraging steel alloy of claim 1, in which aluminium is provided at a concentration of:

1.75 to 1.85 percent by weight; or 1.8 percent by weight.

9. The maraging steel alloy of claim 1, in which the carbide former is niobium.

10. The maraging steel alloy of claim 1, in which the carbide former is vanadium.

11. A cast or forged form of the maraging steel alloy of claim 1.

12. A method comprising applying the maraging steel alloy of claim 1 in a component part of a gas turbine engine.

13. An article comprising the maraging steel alloy of claim 1.

14. A method of producing a maraging steel alloy, comprising:

obtaining a set of constituent elements for a maraging steel alloy;

adding microalloying constituents including carbon and a carbide former;

forming the maraging steel alloy of claim 1, including the formation of carbides at prior austenite grain boundaries to increase Zener drag.

15. The method of claim 14, in which the carbon and carbide former are provided at a stoichiometric concentration.

16. The method of claim 14, in which the carbide former:

niobium; or vanadium.

* * * * *